United States Patent [19]

Schmidt

[11] 4,015,381

[45] Apr. 5, 1977

[54] ROUND BUILDING WITH COMBINED CENTER SUPPORT TUBE AND FLUE STRUCTURE

[76] Inventor: Norbert T. Schmidt, 716-10th Ave. East, Alexandria, Minn. 56308

[22] Filed: Sept. 24, 1975

[21] Appl. No.: 616,301

[52] U.S. Cl. ..... 52/199; 52/219; 52/236.2

[51] Int. Cl.[2] ..... E04H 1/00

[58] Field of Search ..... 52/237, 82, 65, 218, 52/219, 73, 92, 199, 751, 752, 721

[56] References Cited

UNITED STATES PATENTS

| | | | |
|---|---|---|---|
| 1,977,389 | 10/1934 | Kramer | 52/218 X |
| 2,954,727 | 10/1960 | Katt et al. | 52/199 X |
| 3,257,930 | 6/1966 | Averna | 52/199 X |
| 3,633,325 | 1/1972 | Bartoli | 52/237 X |
| 3,707,812 | 1/1973 | Roessl | 52/237 X |
| 3,807,101 | 4/1974 | Cole | 52/237 X |
| 3,827,200 | 8/1974 | Preissler | 52/237 X |
| 3,921,354 | 11/1975 | Connelly et al. | 52/237 |

*Primary Examiner*—Price C. Faw, Jr.
*Assistant Examiner*—Carl D. Friedman
*Attorney, Agent, or Firm*—Clarence A. O'Brien; Harvey B. Jacobson

[57] ABSTRACT

A foundation is provided and includes an upstanding perimeter wall structure enclosing a generally circular plan area of the foundation. The perimeter wall is supported from the foundation and a central upstanding roof support column is also provided and is supported at its lower end from the foundation centrally of the area enclosed by the perimeter wall structure. The column is tubular and a support frame encircles and is supported from the upper end of the column at a level spaced above the upper portions of the perimeter wall structure. The support frame is spaced outwardly of the column and downwardly and outwardly inclined roof rafter members are spaced about the column in generally radial planes with their upper innermost end portions anchored relative to corresponding portions of the frame and their lower outermost end portions anchored relative to corresponding upper marginal portions of the perimeter wall structure. A roof structure is secured over the rafter members and includes a central void area defined by upper marginal portions of the roof structure spaced outwardly from and extending about the upper end portion of the column. A cap structure is supported from the upper marginal portions of the roof structure and the upper end portion of the column forming a weather closure over the upper portion of the roof structure. The foundation supports a heater including a flue opening into the interior of the column and the roof structure includes inner lower panel structures underlying the rafters as well as insulation material disposed between adjacent rafters and overlying the inner panel structure but spaced from the upper marginal portions of the rafters, the spacing between adjacent rafters above the insulation material defining air circulation passages and the cap structure including a ventilation outlet for venting the air circulation passages and seal structure forming an air seal against airflow between the column outer surface and the adjacent inner portions of the roof structure.

9 Claims, 7 Drawing Figures

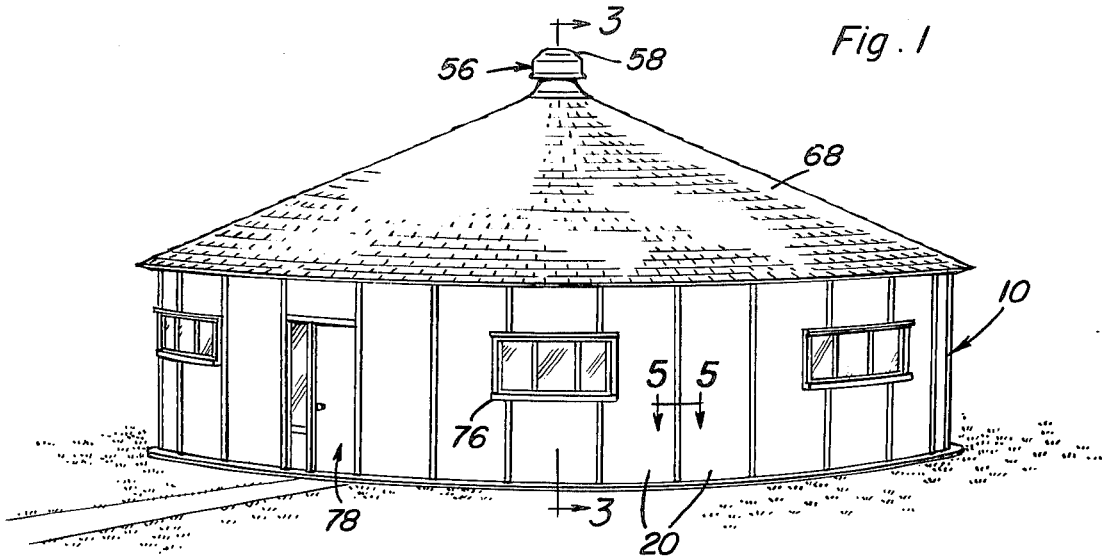
Fig. 1
Fig. 2
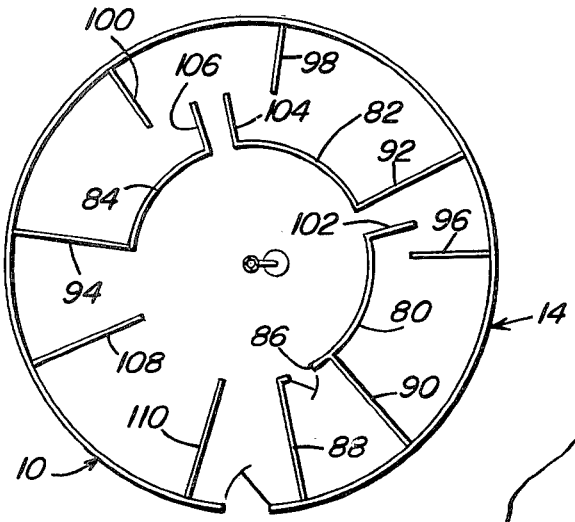
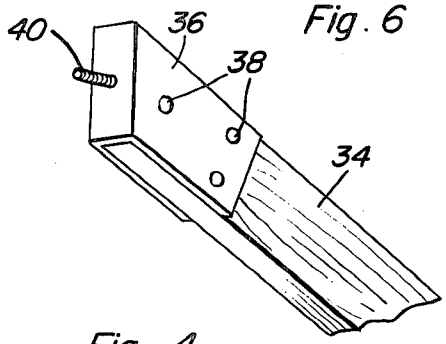
Fig. 6
Fig. 4
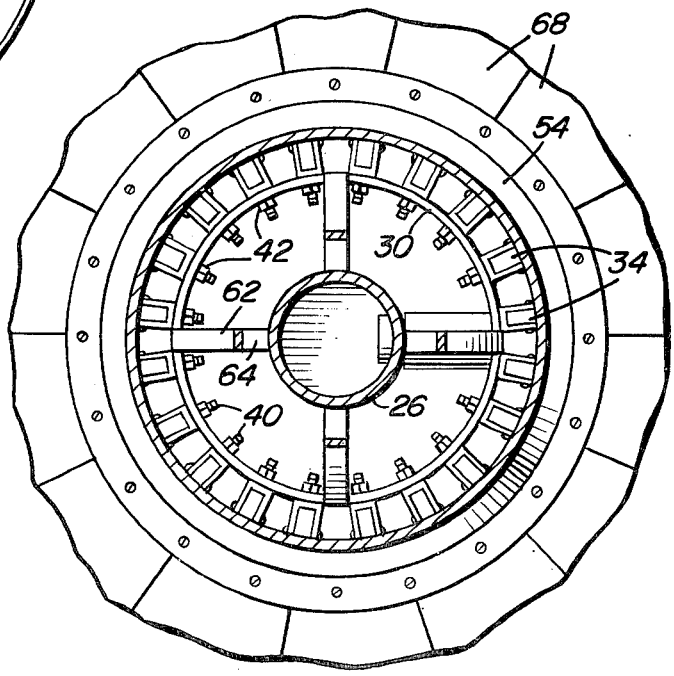
Fig. 5
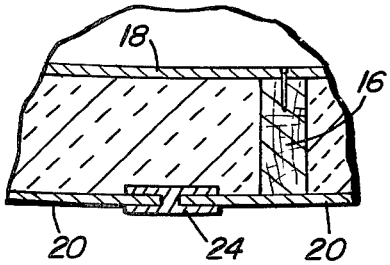

114
124
126
34
122
124
116
118
120

58
60
54
4
56
4
62
64
30
66
68
46
44
34
48
50
32
52
14
76
18
20
12
22
130
130
130
26
28
74
72
70

ROUND BUILDING WITH COMBINED CENTER SUPPORT TUBE AND FLUE STRUCTURE

BACKGROUND OF THE INVENTION

Circular building structures including center support posts have been heretofore provided, but have not been constructed in a manner suitable for comfortable occupation by humans, suitably insulated from both cold and hot weather and also constructed of simple basic building components for ease in construction and economy of materials.

Examples of previously known building structures including some of the basic features of the instant invention are disclosed in U.S. Pat. Nos. 886,477, 932,243, 2,054,128, 2,183,645, 2,211,395 and 2,282,756.

BRIEF DESCRIPTION OF THE INVENTION

The building structure of the instant invention employs a foundation and a circular perimeter wall supported from the foundation as well as a center upright column having its lower end supported from the foundation. A plurality of downwardly and outwardly inclined generally radial roof rafters have their upper ends supported from an upper frame mounted from an upper portion of the column in spaced relation thereto and their lower ends anchored to the upper marginal portions of the outer peripheral wall. Inner and outer roof panels are secured between the rafters below and above the latter, respectively, and insulating material is disposed between adjacent rafters over the inner panel structure and spaced below the outer panel structure thereby forming ventilation air passages between the rafters immediately beneath the outer panel structure of the roof. A cap assembly is secured over the center peak of the roof structure and includes a vent outlet for the air circulation passages as well as an air seal structure against the flow of air outwardly of the building interior about the upper end of the column. The column is tubular and the interior of the building includes a heating assembly equipped with a flue duct discharging into the hollow column, the upper end of the column being open to the atmosphere for venting flue gases therefrom.

The interior of the building includes a unique combination of partial cylindrical interior walls disposed generally concentric with the outer perimeter wall of the building and which are angularly spaced from each other and the inner partial cylindrical walls have outwardly radiating partition walls connected thereto and in operative association with inwardly projecting radial partition walls extending inwardly from the outer perimeter wall of the building, some of the radially inwardly projecting partitions extending from the outer perimeter wall extending fully inwardly to corresponding inner partial cylindrical wall portions and other inwardly projecting wall portions terminating at points spaced outwardly of the partially cylindrical inner wall portions.

The main object of this invention is to provide a unique circular building construction having a circular outer perimeter wall and a center upright support column from whose upper portions the major and minor diameter portions of a generally truncated cone-shaped roof structure are supported with the center column being hollow and usable as a heater flue pipe.

Another important object of this invention is to provide a circular building construction including building components which may be readily fabricated and erected on the building site or prefabricated at a manufacturing point and shipped to the building site.

A further object of this invention is to provide a circular building construction including a novel arrangement of inner substantially concentric and relatively angularly displaced partial cylindrical partitions enjoying coaction with radial partitions extending fully and partially between the inner partial cylindrical partitions and the outer perimeter wall of the building structure.

A final object of this invention to be specifically enumerated herein is to provide a round building structure which will conform to conventional forms of manufacture, be of simple construction and easy to erect so as to provide a device that will be economically feasible and more readily and quickly erected on the building site.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the circular building construction of the instant invention;

FIG. 2 is a schematic view of a preferred floor plan of the building construction;

FIG. 4 is an enlarged fragmentary horizontal sectional view taken substantially upon the plane indicated by the section line 4—4 of FIG. 3;

FIG. 5 is an enlarged fragmentary horizontal sectional view taken substantially upon the plane indicated by the section line 5—5 of FIG. 1;

FIG. 6 is a fragmentary perspective view of one of the rafter members of the building illustrating a first manner of securing the inner upper ends of the rafter to the center column supported frame therefor.

DETAILED DESCRIPTION OF THE INVENTION

Figures 3, 7:
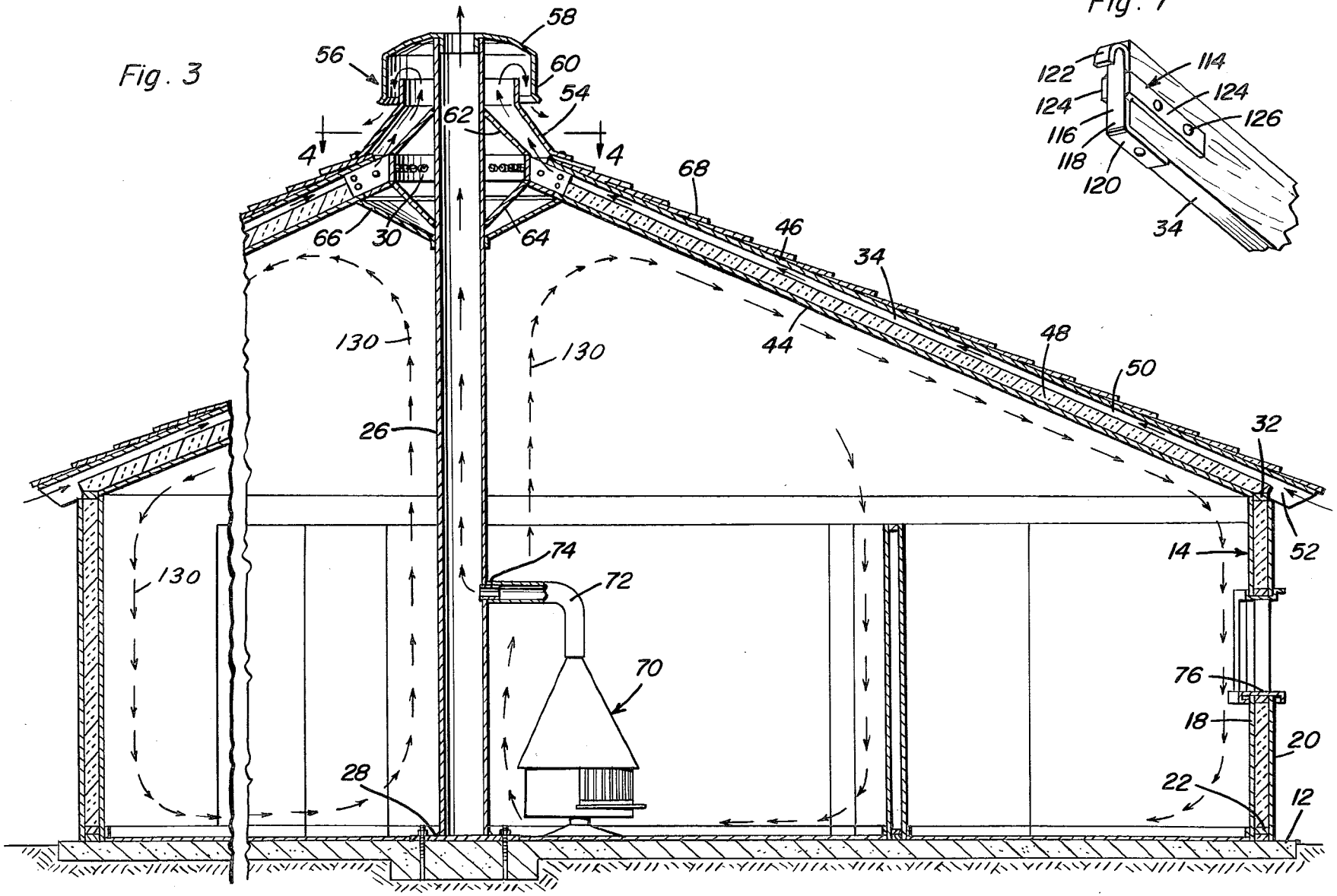
FIG. 3 is an enlarged fragmentary vertical sectional view taken substantially upon the plane indicated by the section line 3—3 of FIG. 1.
FIG. 7 is a fragmentary perspective view illustrating a second manner of constructing the upper ends of the roof rafters for attachment to the column supported frame therefor.

Referring now more specifically to the drawings, the numeral 10 generally designates a building constructed in accordance with the present invention including a foundation 12 of any suitable design. The building 10 includes an upstanding perimeter wall assembly referred to in general by the reference numeral 14 and which is generally cylindrical in configuration. The perimeter wall structure 14 includes circumferentially spaced upstanding studs 16 disposed between inner and outer wall panel sections 18 and 20. The lower ends of the studs 16 may of course be secured to suitable foundation anchored members 22 extending about the periphery of the building 10 and the panel sections 18 and 20 may each be secured to each of the studs 16 with vertical joining strips 24 utilized between adjacent vertical edges of the panels 18 and 20.

The center of the building structure 10 includes an upstanding column 26 whose lower end is secured to the foundation 12 as at 28 in any convenient manner. The column 26 is hollow and an upper support frame 30 extends about the upper end portion of the column 26 and is supported therefrom in outward spaced relation relative thereto.

The upper ends of the studs 16 are connected by peripherally extending plates 32 and a plurality of rafters 34 are disposed about the upper end of the column 26 and are inclined downwardly and outwardly therefrom. The upper ends of the rafters 34 include U-shaped end caps 36 secured thereover by means of fasteners 38 and the end caps 36 include threaded mounting studs 40 projecting endwise outwardly therefrom. The studs 40 are secured through corresponding apertured portions of the frame 30 by means of suitable nuts 42 and the outer ends of the rafters 34 are secured to the members 32. An inner panel structure 44 is secured between and beneath the rafters 34 and an outer panel structure 46 is secured between and over the rafters 34. Insulation material 48 is disposed between adjacent rafters 34 and is spaced beneath the outer panel structure 46 to define ventilation air passages 50 between adjacent rafters 34. The lower ends of the ventilation air passages are open as at 52 and the upper ends of the rafters 34 are spaced apart with the upper ends of the passages 50 opening into the lower end of an outer sleeve portion 54 of a cap structure referred to in general by the reference numeral 56 closing the upper end of the roof structure. The upper end portion of the column 26 projects above the upper end of the sleeve portion 54 and includes a centrally apertured and downwardly opening cap element 58 secured thereto and extending downwardly over the upper end of the sleeve portion 54 in spaced relation relative thereto whereby ventilation air from the passages 50 moves upwardly through the sleeve portion 54 and then downwardly and outwardly between the upper end of the sleeve portion 54 and the lower skirt portion 60 of the cap element 58.

The frame 30 is supported from the column 26 by means of upper and lower structural members 62 and 64 and an inverted truncated cone-shaped trim shield and air seal structure 66 is secured between the column 26 and the upper inner marginal portions of the inner panel structure 44. Of course, suitable shingle structures 68 may be secured over the outer panel structure 46 with the lower end of the outer sleeve portion 54 secured over the uppermost shingles 68 in the manner of a flashing structure.

The interior of the building 10 includes a heater referred to in general by the reference numeral 70 supported from the foundation 12 and including a flue pipe 72 opening into the interior of the column 26 as at 74. Accordingly, flue gases from the heater 70 are vented outwardly of the building 10 through the center tubular support column 26. Also, the peripheral wall structure 14 includes various peripherally spaced window structures 76 and at least one entrance and exit door assembly referred to in general by the reference numeral 78. Further, and with attention invited now more specifically to FIG. 2 of the drawings, the interior of the building 10 includes three partial cylindrical partitions 80, 82 and 84 angularly displaced relative to each other with the partition 80 including a doorway 86 therethrough. Also, the interior of the building 10 includes four generally radial partition walls 88, 90, 92 and 94 extending between the partitions 80, 82 and 84 and the peripheral wall structure 14 and partial radial partitions 96, 98 and 100 extend inwardly from the perimeter wall structure 14 but terminate outwardly of the partitions 80, 82 and 84, the latter including outwardly extending radial partitions 102, 104 and 106, respectively, extending outwardly therefrom but terminating inwardly of the perimeter wall structure 14. The partition 102 is spaced between the partitions 92 and 96 and the partitions 104 and 106 are spaced adjacent each other between the partitions 88 and 100. Also, generally radial dividers 108 and 110 extend radially inwardly from the perimeter wall structure 14.

With attention now invited more specifically to FIG. 7 of the drawings there may be seen a modified form of end cap referred to in general by the reference numeral 114 for securement to the upper inner ends of the rafters 34. The end cap 114 includes an L-shaped member 116 including a vertical leg 118 extending upwardly along the inner end of the rafter 34 and a short leg 120 extending outwardly beneath the upper portion of the lower marginal edge of the rafter 34 from the lower end of the leg 118. The upper end of the leg 116 is turned inwardly and downwardly as at 122 in order to define a hook which may be hooked over and secured to the frame 30. Also, the end cap 114 includes opposite side straps 124 secured to opposite sides of the upper end of the rafter 34 by means of fasteners 126 and to the opposite sides of the mid-portion of the vertical leg 118 in any convenient manner such as by welding.

Because of the ventilation air passages 50 the heat load experienced by the building 10 on sunny days is minimal. Further, heating of the interior of the building 10 during cold weather by means of the heater 70 may be accomplished economically because of the convection air currents 130 and because of the additional heating afforded by the column 26 during heating operations. Also, the central area of the interior of the building 10 is surrounded by the outer peripheral room areas which need not be heated to as great a temperature and the central area may therefore be maintained at a warmer temperature in cool weather with less fuel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a generally circular building having a foundation, an upstanding perimeter wall supported from and enclosing a generally circular interior area above said foundation, a roof structure bridging the upper marginal portions of said perimeter wall and defining a vaulted ceiling closure for said interior area, a plurality of angularly spaced upstanding partial cylindrical interior partition walls supported from said foundation spaced inwardly of said perimeter wall, said partition walls being generally concentric relative to said perimeter wall and defining a substantially open central portion of said interior area inwardly of said partition walls, one end of each of said partition walls including an upstanding full radial partition extending between the partition wall and a corresponding portion of said perimeter wall and the other end of each of said partition walls including an upstanding partial portion extending outwardly toward but terminating a spaced distance inwardly of a corresponding portion of said perimeter wall, partial inwardly projecting partitions extending inwardly from peripherally spaced portions of said perimeter wall toward and terminating outwardly of portions of said partition walls spaced intermediate the corresponding full and partial partitions thereof, a space heater structure mounted centrally within said interior area, said interior area being substantially completely open, in vertical directions, from said foundation to said vaulted ceiling, for vertical air flow currents therein, whereby rising convection air currents of heated air may be generated in the central portion of said interior area by said space heater structure and the convection air currents may thereafter move downwardly along the inner surfaces of said vaulted ceiling and perimeter wall and thereafter inwardly over said foundation toward said central portion of said interior area, said building including a central upstanding roof support column supported at its lower end from said foundation centrally of said area, at least an upper portion of said column being hollow, a support frame encircling and supported from said column at a level spaced above the upper portions of said perimeter wall structure and spaced outwardly of said column, said roof structure including downwardly and outwardly inclined roof rafter members spaced about said column in generally radial planes with their upper innermost end portions anchored relative to corresponding portions of said frame and their lower outermost end portions anchored relative to the upper portions of corresponding portions of said perimeter wall structure, said roof structure including a central void area defined by upper marginal portions of said roof structure spaced outwardly from and extending about the upper end portion of said column, and a cap structure supported from said upper marginal portions of said roof structure toward and terminating outwardly of portions of said partition walls spaced intermediate the corresponding full and partial partitions thereof.

2. The combination of claim 1 wherein said heater structure includes a flue duct opening into the interior of said column below said roof structure.

3. The combination of claim 1 wherein said roof structure includes a lower panel structure secured to and beneath said roof rafter members and an upper panel structure secured to and over said rafter members, and insulation material disposed between said rafter members over said lower panel structure and spaced below said upper panel structure, the upper ends of said rafter members being spaced apart and the spaces between adjacent rafter members above said insulation material and below said upper panel structure being open at their lower ends to the exterior of said wall structure, said cap structure including an upstanding outer sleeve portion secured at its lower periphery to the upper portions of said roof structure and disposed about said upper end portion of said column and a downwardly opening cap element loosely telescoped downwardly over the upper end portion of said outer sleeve portion with the upper closed end of said cap element spaced above the upper end of said sleeve portion.

4. The combination of claim 3 wherein the upper end of said column opens upwardly through the upper closed end of said cap element.

5. In combination, a foundation, an upstanding perimeter wall structure enclosing an interior area of generally regular plan shape within the confines of said perimeter wall structure and with the latter supported from said foundation, a central upstanding roof support column supported at its lower end from said foundation centrally of said interior area, at least an upper portion of said column being hollow, a support structure encircling and supported from an upper portion of said column at a level spaced above the upper portions of said perimeter wall structure and including mounting portions spaced about and outwardly from said column, a roof structure bridging the upper marginal portion of said perimeter wall structure and closely embracing said upper portion of said column to thereby close said interior area from above, said roof structure including downwardly and outwardly inclined roof rafter members spaced about and generally radiating outwardly from said column with their upper inner ends supported from said mounting portions and their lower outer ends supported from upper portions of said perimeter wall structure, outer roof panels secured over said rafters, said roof structure defining an upper central void area defined by upper marginal portions of said roof structure spaced outwardly from and extending about the upper end of said column, a cap structure supported from said upper marginal portions of said roof structure and the upper portion of said column forming a weather closure over said roof structure upper marginal portions and substantially sealed relative thereto, said hollow upper end portion opening upwardly through said cap structure, a space heater structure supported in a lower portion of said interior area adjacent the center portion thereof, said heater structure including a flue duct opening into the interior of said hollow portion of said column below said roof structure, means establishing a seal against air flow from within said interior area below said roof structure outwardly through said central void area, said roof structure defining the vaulted ceiling from said interior area, said interior area being substantially completely open, in vertical directions, from said foundation to said vaulted ceiling, for vertical air flow currents therein, whereby rising convection air currents of heated air may be generated in the central portion of said interior area by said space heater and the hollow portion of said column upwardly through which heated flue gases from said heater are vented and the convection air currents may thereafter move downwardly along the inner surfaces of said vaulted ceiling and perimeter wall structure and thereafter inwardly over said foundation toward said central portion, at least portions of the outer periphery of said central area being partitioned through the utilization of upstanding partitions supported from said foundation and extending inwardly from spaced portions of said perimeter wall structure toward said column, said partitions terminating upwardly, along at least major length portions of the upper marginal edges thereof, below said roof structure and the portions of said interior area defined between adjacent partitions being open from said foundation to said ceiling.

6. The combination of claim 5 wherein said roof structure includes a lower panel structure secured to and beneath said roof rafter members and an upper panel structure secured to and over said rafter members, and insulation material disposed between said rafter members over said lower panel structure and spaced below said upper panel structure, the upper ends of said rafter members being spaced apart and the spaces between adjacent rafter members above said insulation material and below said upper panel structure being open at their lower ends to the exterior of said wall structure, said cap structure including an upstanding outer sleeve portion secured at its lower periphery to the upper portions of said roof structure and disposed about said upper end portion of said column and a downwardly opening cap element loosely telescoped downwardly over the upper end portion of said outer sleeve portion with the upper closed end of said cap element spaced above the upper end of said sleeve portion.

7. The combination of claim 5 wherein the upper end of said column opens upwardly through the upper closed end of said cap element.

8. The combination of claim 5 wherein the upper inner end portions of said rafter members include end structures secured thereto equipped with endwise outwardly projecting studs secured through corresponding peripheral portions of said frame.

9. The combination of claim 5 wherein the upper inner end portions of said rafter members include end structures secured thereto defining downwardly opening hook structures hooked over and secured to corresponding peripheral portions of said frame.

* * * * *